United States Patent [19]

Butler

[11] 3,935,926

[45] Feb. 3, 1976

[54] EXTENSION LADDER

[75] Inventor: Jerry Allan Butler, Waterloo, Iowa

[73] Assignee: Chamberlain Manufacturing Corporation, Elmhurst, Ill.

[22] Filed: Oct. 9, 1974

[21] Appl. No.: 513,310

[52] U.S. Cl. ..... 182/208; 182/210

[51] Int. Cl.[2] ..... E06C 1/12

[58] Field of Search ..... 182/207, 208, 209, 210, 182/211, 212, 213, 107, 108; 312/341 NR

[56] References Cited

UNITED STATES PATENTS

| | | | |
|---|---|---|---|
| 3,331,468 | 7/1967 | Redman | 182/209 |
| 3,343,630 | 9/1967 | Redman | 182/209 |
| 3,491,853 | 1/1970 | Stillman | 182/207 |

FOREIGN PATENTS OR APPLICATIONS

| | | | |
|---|---|---|---|
| 616,197 | 1/1961 | Italy | 312/341 N |

*Primary Examiner*—Reinaldo P. Machado
*Attorney, Agent, or Firm*—Hill, Gross, Simpson, Van Santen, Steadman, Chiara & Simpson

[57] ABSTRACT

An extension ladder including a base section and a fly section, each having a pair of side rails and including, mounted at the ends of each of the side rails, a guide unit interconnecting the adjacently sliding side rails of the fly and base section, said guide unit also including an integrally formed cut protector portion and slide pad.

16 Claims, 12 Drawing Figures

Fig. XI

EXTENSION LADDER

This invention relates to extension ladders and, more particularly, to guide means for interconnecting adjacently sliding side rails of the extension ladder portions.

In the past, guide units or guide flanges have been used to interconnect the ends of base and fly sections of extension ladders to guide the movement of one section with respect to the other. End caps also have been provided at the ends of such base and fly sections to protect a user against the sharp metal edges at the ends of the base and fly sections. In the past the guide unit has been a separate piece and the end cap has also been a separate piece. This, of course, requires initially that the pieces be separately manufactured. Then, when the pieces are assembled onto the base and fly sections of the ladder side rails, separate assembly operation is required for each of the two pieces. In some instances the end caps have been made of plastic or hard rubber. In order to overcome some of the disadvantages resting in the initial manufacture and in the subsequent assembly of these units, it has become appropriate to try to devise a structure which would incorporate both a guide unit and an end cap or cut protector, as it is sometimes referred to.

SUMMARY OF THE INVENTION

It is a principal object of this invention to provide a combination guide unit and cut protector unit for assembly onto the ends of side rails of extension ladders.

It is a further object of the invention to provide a guide unit which, when assembled to the side rail of an extension ladder, is effective to reduce the frictional contact between the flanges of adjacent side rails when the side rails are slid relatively to each other.

Another object of the invention is to provide an integral guide unit and cut protector which is easy to manufacture and simple to assemble onto a ladder side rail.

Another object of the invention is to provide an integral guide unit and cut protector unit which lessens the cost of manufacture and which, due to the ease of assembly on the ladder side rail, reduces the overall assembly cost.

Another object of the invention is to provide an integral guide unit and cut protector unit so designed as to limit by casting or secondary operations applied to the casting the amount of dead load deflection possible when the ladder including such units is extended to its maximum usable length.

Another object of the invention is to provide an integral guide unit and cut protector unit so designed as to distribute the tension loading of the hook area of the guide unit over approximately one-half the width of the hook portion.

By way of summary, it may be stated that this invention which relates particularly to divising a combination guide unit and cut protector unit made as a die cast alloy or other suitable materials allows easy and convenient attachment to the end of side rail units, thus guiding the side rail units with respect to each other and, at the same time, allowing movement of the side rails with respect to each other with a minimum of frictional resistance. This integral unit also provides means for protecting a ladder user against the dangers of being cut by the sharp metal edges of the ends of the ladder side rails.

Other objects and advantages of the invention will become more apparent from the following description and the accompanying drawings.

BRIEF DESCRIPTION OF THE DRAWINGS

FIG. 11 is an enlarged view of a portion of FIG. 9 showing the engagement of a guide unit on the lower end of the fly section engaging a side rail of the base section.

DESCRIPTION OF A PREFERRED EMBODIMENT

Figure 1:
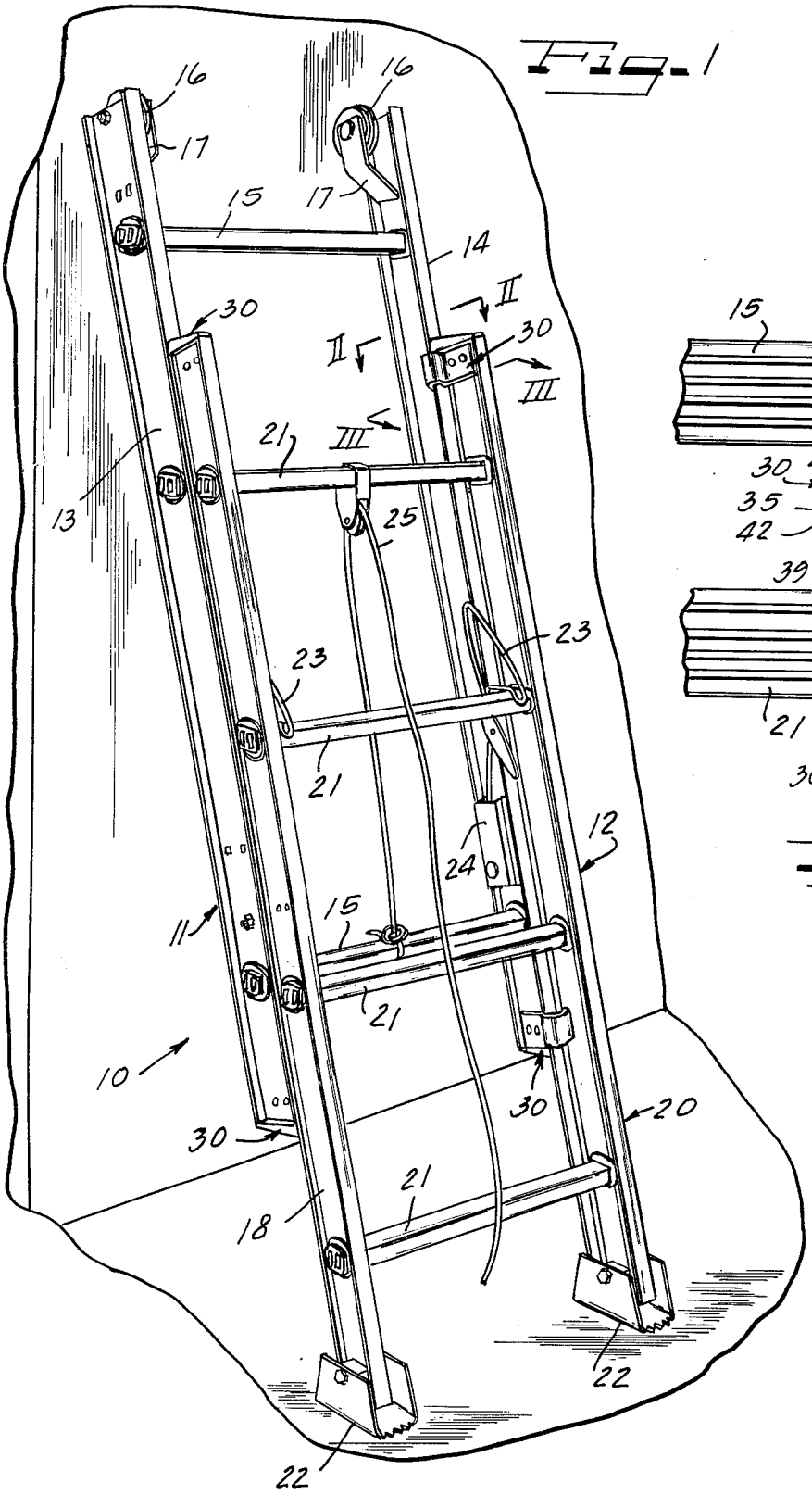
FIG. 1 is a perspective view of an extension ladder having a base section and a fly section and utilizing guide units in accordance with the invention herein.

Referring now to the drawings in which like parts are designated by like reference characters, thereis shown in FIG. 1 a perspective view of an extension ladder designated generally by the numeral 10. The extension ladder 10 comprises a fly section 11 and a base section 12. The fly section 11 comprises a pair of side rails 13 and 14 between which extend a plurality of ladder rungs 15. At the upper ends of the side rails 13 and 14 of the fly section 11 there is arranged a pair of roller members 16, each mounted on brackets 17 attached to the respective side rails 13 and 14. These rollers serve as a guide and rest against a building or house as the fly section of the ladder is raised with respect to the base section.

The base section 12 of the extension ladder 10 also comprises a pair of side rails 18 and 20. The side rails 18 and 20 are interconnected by transversely extending ladder rungs 21. The base section is also provided at its lower end with conventional foot pads 22 on each of the side rails 18 and 20. Furthermore, conventional catch members 23 mounted on brackets 24, secured to the fly section, are used in securing the fly section with respect to the base section and maintaining it in a desired position. These conventional catch members, of course, engage rungs 21 on the base section 12 when the fly section is hoisted by means of the rope and pulley arrangement 25. The side rails of the fly section, of course, slide adjacently to the side rails of the base section when the fly section is moved up and down.

As further seen in FIG. 1, a guide unit or guide bracket 30 is attached to the upper ends of each of the side rails 18 and 20 of the base section 12. It is a guide unit with a cut protector unit integrally formed thereon. Such a combined guide and cut protector unit is also attached to the bottom end of each of the side rails 13 and 14 of the fly section 11. Such a guide unit 30 is shown in perspective in FIGS. 5 and 6.

Figure 2:
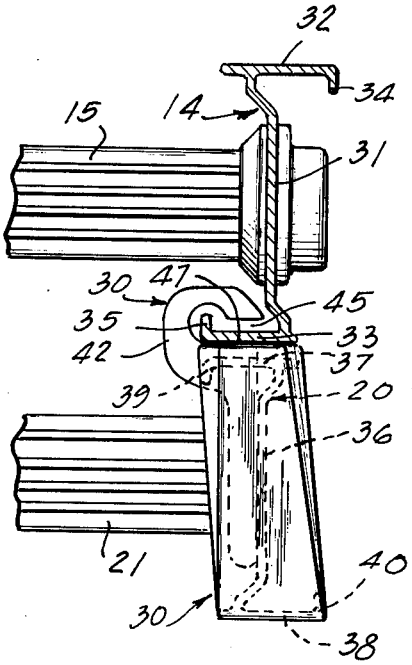
FIG. 2 is a plan view taken at line 2—2 of FIG. 1, showing an interconnection of adjacent side rails of a fly and base section interconnected with the guide unit embodying the invention herein.
Figure 3:
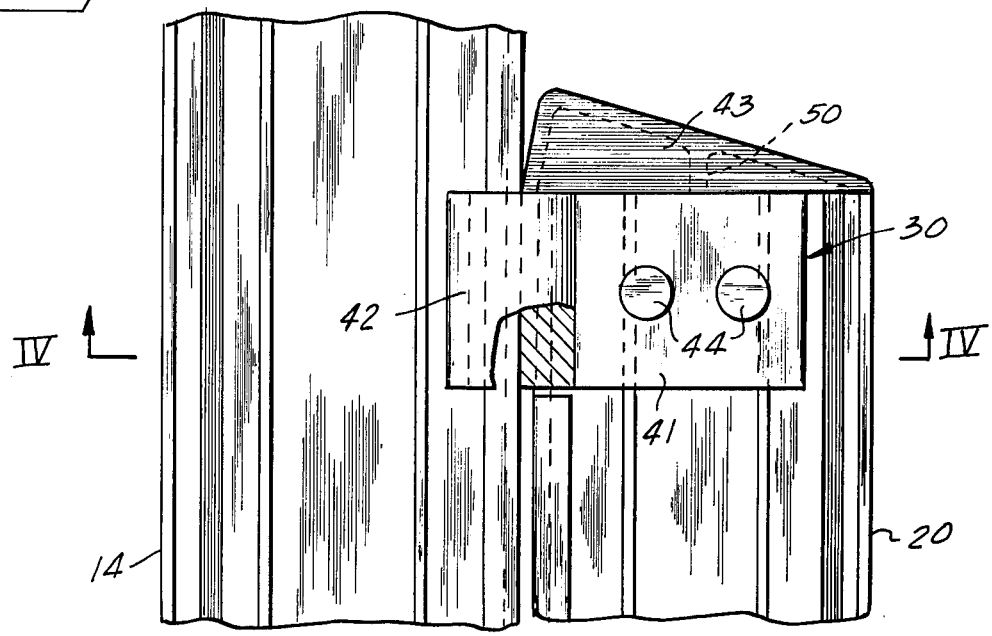
FIG. 3 is a view in elevation taken along line 3—3 of FIG. 1 showing a portion of adjacent side rails of fly and base sections of an extension ladder connected with the guide unit of the invention.
Figure 4:
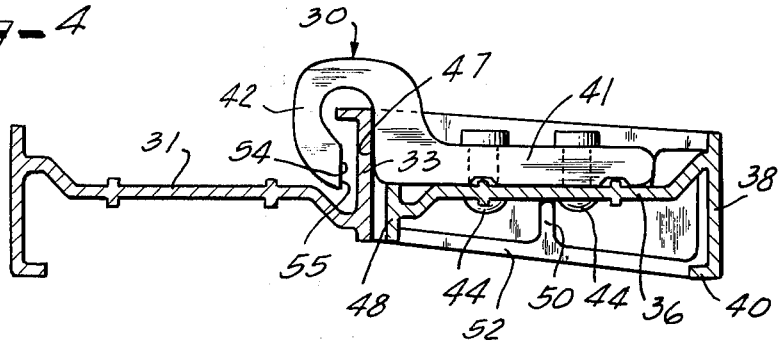
FIG. 4 is a plan view taken through the line 4—4 of FIG. 3.

In FIG. 2 there is shown in cross section the side rail 14 of the fly section and the slide rail 20 of the base section disposed adjacently thereto. Interconnecting the two side rails is the guide unit 30. Such interrconnection is also shown in the elevation view of FIG. 3 and in the bottom plan view of FIG. 4.

The side rail 14 comprises a central web portion 31 at each longitudinal edge of which are connected transversely extending flanges 32 and 33, which extend in opposite directions from the points at which they join the web portion 31. An inturned lip portion 34 is formed on the free end of flange 32 and an inturned lip portion 35 is formed on the free end of flange 33.

The side rail 20 of the base section is similarly constructed, having a web portion 36 with flange portions 37 and 38 connected to opposite longitudinal edges of the web portion and extending transversely therefrom in opposite directions. Similarly, as with side rail 14 inturned lips 39 and 40 are formed at the free ends of the flanges 37 and 38 respectively.

Figure 7:
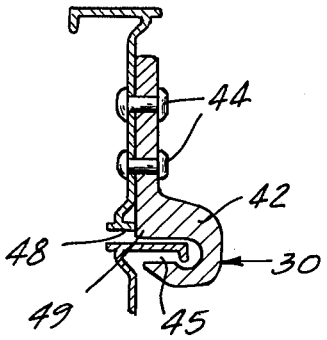
FIG. 7 is a plan view in section taken along the line 7—7 of FIG. 6.

The combined guide and cut protector unit 30 which may be made of a die cast alloy comprises a substantially flat base section 41, a single hook portion 42 integrally formed with the base section 41, and a cut protector portion 43 formed integrally on one edge of the base section 41. Conceivably, this unit could also be molded of any material suitable to molding which would have sufficient physical properties such as a very durable plastic. In the ladder assembly, the guide unit 30 is fixed to a web of the side rails and, as shown in FIGS. 2, 3, 4 and 5 is attached to the web 36 by means of rivets 44. It will be observed from FIG. 2 as well as from FIG. 7 that the single hook portion 42 extends laterally from the base section 41 so that the mouth 45 of the single hook portion is adapted to fit over the flange of an adjacent side rail, in the case of FIG. 2 that being over the flange 33 of the side rail 14 of the fly section 11.

Figure 5:
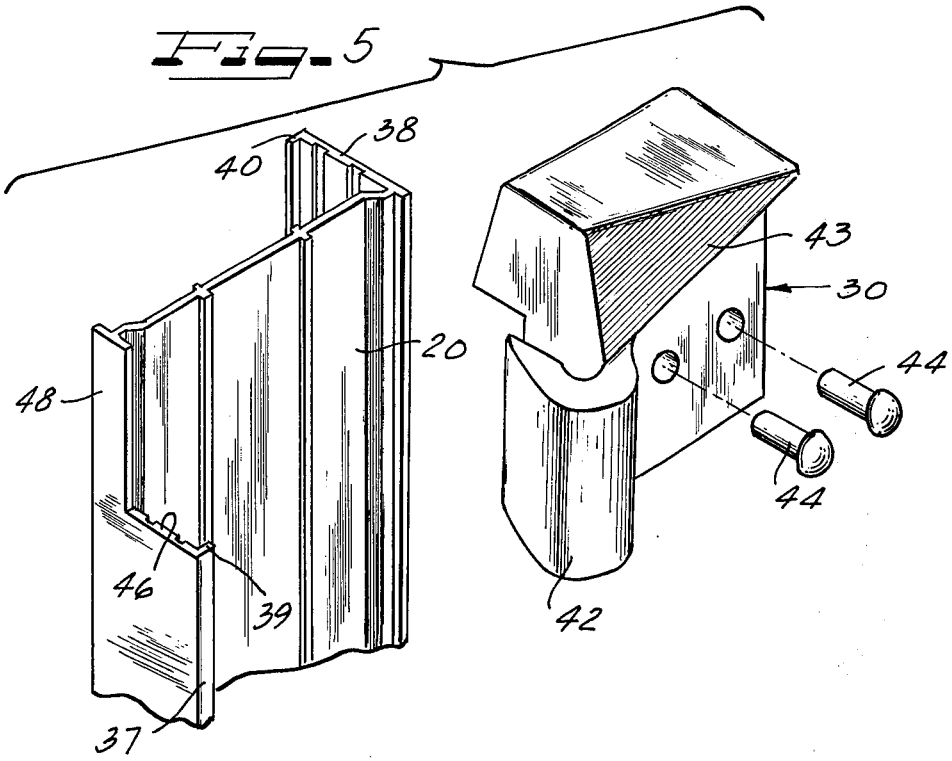
FIG. 5 is an exploded view in perspective of the upper portion of a ladder side rail and the combined guide unit and cut protector which is adapted to be assembled thereto.
Figure 6:
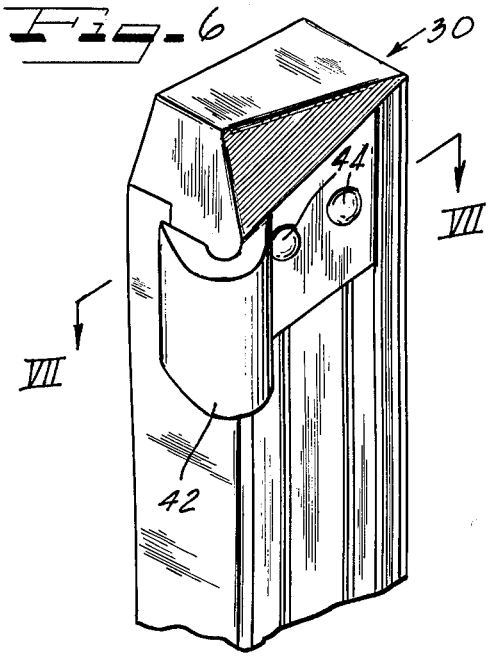
FIG. 6 is a perspective view of the end of a ladder side rail with the combined guide unit and cut protector of the invention assembled thereto.

From FIG. 5 it will be observed that a notch 46 substantially rectangular in shape is formed in the upper end of the side rail, considering that the side rail shown in FIG. 5 is the upper end of side rail 20 of the base section 12. The purpose of this notch is to permit the flat inner surface 47 forming part of the mouth 45 of the single hook portion 42 of the guide unit 30 to project beyond the outer face 48 of the flange 37 by an amount which may be approximately one-sixteenth of an inch. Viewing FIGS. 4 and 7 in particular, it will be observed that this extension beyond the outer surface 48 in effect forms an pad 49 upon which the flange 33 of the adjacent side rail of the fly section can ride. In other words, the flange 33 of the fly section and the flange 37 of the base section do not ride upon each other. With four such guide units 30 connected respectively at the top ends of the base section side rails and the bottom ends of the fly section side rails, it will be appreciated that the side rails do not slide upon each other, but rather slide on the surfaces 47 of the pads 49. This, it will be appreciated, is effective to substantially reduce the frictional drag from the otherwise sliding contact that would occur between the full length of the side rails in their up and down movement with respect to each other. This obviously also saves wear and tear on the side rail flanges.

It will be apparent from the several views that the so-called cut protector portion 43 which is formed as an integral part of the guide unit 30 and in the form of a cap-like unit conveniently covers the ends of the side rails. It is a safety device to protect the ladder user against the normally sharp edges on the ends of the side rails. As a die cast piece the upper surface of the cut protector portion 43 is very smooth. The shape of the portion 30 is somewhat trapezoidal but this obviously could be varied depending on the cross-sectional configuration of side rail.

A rib 50 is formed on the underside of the cap-like portion and extends between the base section 41 and the overhanging flange 52, which depends from the upper surface of 52 of the cut protector portion 43. Utilizing this rib allows the cap-like portion to be made with a minimum wall thickness, thereby utilizing a minimum amount of material and presenting maximum cost savings. The rib 51, of course, adds structural strength to that portion of the combined guide unit and cut protector which covers the cross sectional end of the side rail.

Figure 3A:
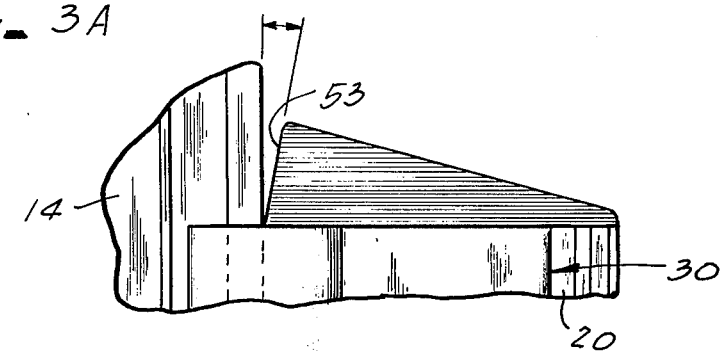
FIG. 3A is a partial view in elevation of a guide unit showing its upper face at an angle.

The guide unit 30 may also have the upper forward surface 53 tapered at an angle of approximately 10°–30° as shown in FIG. 3A. This is in order to allow minimum surface for opposing side rail contact to further reduce the friction when there is movement between opposing side rail sections.

It should further be noted that when the base and fly sections are positioned with a maximum clearance with respect to each other (viewing FIG. 4, for example) the underside of flange 33 comes into contact with the hooked surface 54. This contact transmits all load stress to a point 55 at the very end of the hook 54, that is, as close as possible with an imaginary perpendicular plane of the web 31. This allows minimum side rail flange thickness by moving the bending moment of flange 33 as close to its base of origin at the junction with web 31 as possible.

Figure 8:
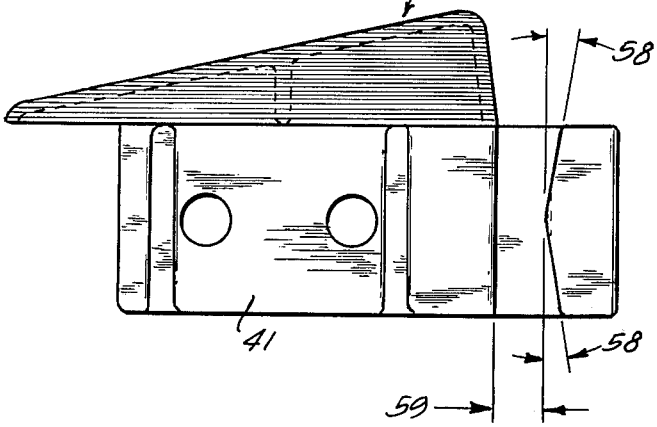
FIG. 8 is a view in elevation of a guide unit showing an angular formation on the hook portion.
Figure 9:
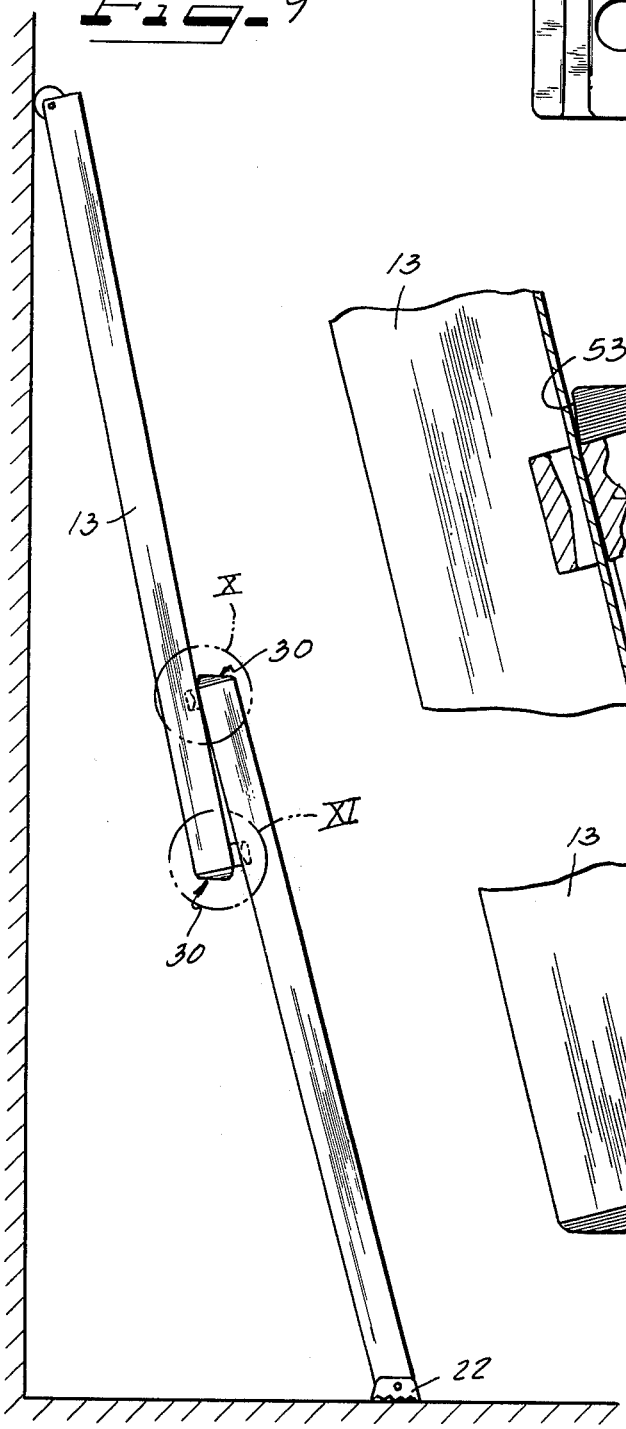
FIG. 9 is a side view in elevation of a pair of interconnected ladders using the guide units herein extended to substantially their full length.
Figure 10:
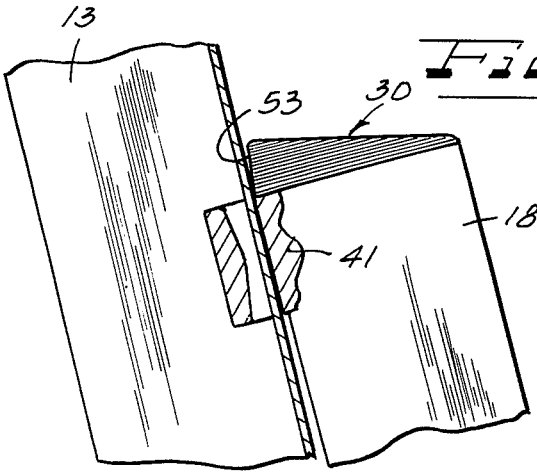
FIG. 10 is an enlarged view of a portion of FIG. 9 showing an interconnection between the guide unit on the upper end of the base section and the side rail of the fly section.
Figure 10:
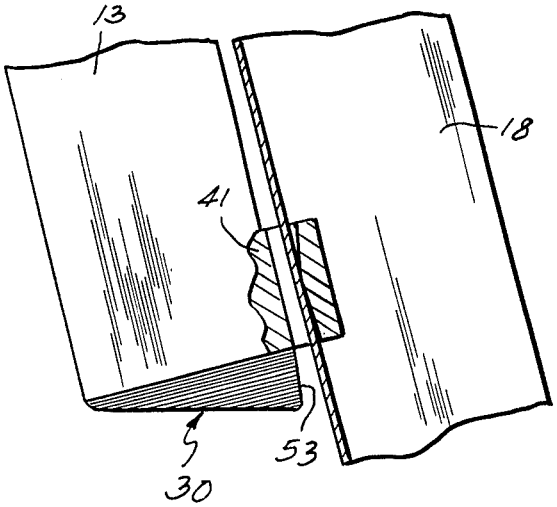

In FIG. 8 the hook portion of the guide unit 30 is shown as being formed with a slight taper running from the midpoint of its height to both the top and bottom of the hook portion to define slight angles designated as 58. This angle 58 on the hook casting is designed to fit a mating side rail as seen in FIG. 11 to insure uniform loading of the load bearing surface on the hook when the ladder is extended and placed in use as seen in FIG. 9. This angle 58 is effective to distribute the tension load on the guide unit over one-half of the hook portion of the unit rather than concentrating the load on one corner of the guide unit if it were flat.

The dimension 59 on the guide unit 30 is cast to fit the thinnest mating side rail flange. As the side rail flange is increased this opening may be cast or milled wider by a secondary operation to create the proper gap and insure correct and acceptable load deflection requirements.

It will be appreciated that guide units of the type described are formed on right and left hand configurations for attachment to the appropriate right or left hand side rails of the base and fly sections.

It will be apparent that there has been advantageously provided by this invention an overall improved extension ladder combination utilizing an integral guide unit and cut protector unit attached to the ends of the side rails in such a manner that minimal surface contact takes place when the base and fly sections are slidingly moved with respect to each other. Furthermore, the attached guide unit has formed integral therewith a safety device in the nature of a cut protector. Since the cut protector and guide device are formed integrally, only one assembly operation is necessary in attaching same to the side rail. Furthermore, the entire guide and cut protector unit may be advantageously manufactured by a die cast molding process which reduces the overall manufacturing cost.

While a preferred embodiment of the invention has been disclosed, it will be appreciated that this has been shown by way of example only and the invention is not to be limited thereto as other variations probably will become apparent to those skilled in the art and the invention is to be given its fullest possible interpretation within the terms of the following claims.

What is claimed is:

1. An extension ladder assembly including a pair of ladder sections including a base section and a fly section, each of said base and fly sections including a pair of side rails and a plurality of rungs interconnecting the side rails of each of the sections respectively, the side rails of said fly section and said base section being disposed adjacent each other, each of said side rails including a central web portion and a pair of flanges formed at opposite longitudinal edges of said web portion, a first pair of guide means fixedly attached at the upper end of the side rails of said base section and a second pair of guide means fixedly attached at the lower end of the side rails of said fly section, said guide means also including means for receiving therein the flange of the adjacent side rail, wherein the improvement comprises, a guide means which includes a base portion for attaching to the web portion of a side rail and a pad means formed thereon so that in the extension ladder assembly said pad means will extend through a flange of a side rail to which it is attached and will slidingly engage the flange of an adjacent side rail to which said guide means is not fixedly attached.

2. The extension ladder assembly of claim 1 wherein said base portion of said guide means is attached to the inner face of said side rails.

3. The extension ladder assembly of claim 1 wherein each of said guide means includes a cut protector portion attahced thereto which overlies the end of the side rail to which said guide means is attached.

4. The extension ladder assembly of claim 1 wherein each of said guide means includes a cut protector portion formed integrally therewith and which overlies the end of the side rail to which said guide means is attached.

5. The extension ladder assembly of claim 4 wherein the forward face of said cut protector portion is formed at an angle with the plane of said pad means so that said forward face does not touch the flange of the adjacent side rail thereby further reducing the amount of surface available for frictional contact with the adjacent side rail.

6. In an extension ladder having a pair of ladder sections including a base section and a fly section, said base section including a pair of side rails and a plurality of rungs interconnecting said side rails of said base section, each of said side rails being formed with a central web portion and a flange portion integrally formed on each of the longitudinally extending edges of said web portion, a first pair of guide means disposed at the upper end of the side rails of said base section, and a second pair of guide means disposed at the lower end of the side rails of said fly section, the improvement wherein each of said guide means includes a substantially flat base portion fixed to said central web section of said side rail, and pad means integrally formed on the forward end of said base portion and extending through the flange of the side rail to which said guide means is attached whereby said pad means may ride on an adjacently disposed side rail of an adjacent ladder section.

7. The extension ladder of claim 6 including cut protector means integrally formed on the edge of said base portion, said last named edge extending substantially at right angles to said pad means.

8. The extension ladder of claim 6 wherein said guide means includes hook means for receiving the flange of an adjacent guide rail therein.

9. The extension ladder of claim 6 including cut protector means integrally formed on the edge of said base portion, said last named edge extending substantially at right angles to said pad means; and said guide means includes hook means for receiving the flange of an adjacent guide rail therein.

10. In an extension ladder having a pair of ladder sections including a base section and a fly section, said base section including a pair of side rails and a plurality of rungs interconnecting said side rails of said base section, each of said side rails being formed with a central web portion and a flange portion integrally formed on each of the longitudinally extending edges of said web portion, a first pair of guide means disposed at the upper end of the side rails of said base section, and a second pair of guide means disposed at the lower end of the side rails of said fly section, the improvement wherein each of said guide means includes a substantially flat base portion fixed to said central web section of said side rail, a single hook portion integrally formed at one end of said base section of said guide means, the mouth of said single hook portion receiving the flange of an adjacent side rail, said single hook portion being formed with a substantially flat internal surface which also defines one end of said base section, and further including means defining a substantially rectangular cutaway portion in the flange portion of the side rail through which said guide means extends so that said internal surface of said single hook portion extends slightly beyond the outer surface of said flange portion to form pad means whereby said pad means may ride on an adjacently disposed drag between the adjacent side rails.

11. In the extension ladder of claim 10 each of said guide means also including a cut protector means integrally formed on the edge of said base portion, said last named edge extending substantially at right angles to said pad means.

12. A combined guide unit and cut protector for attachment to the end of a ladder side rail comprising:

a substantially flat base section adapted to be fixedly attached to a ladder side rail;

a single hook portion integrally formed on said base section and adapted to receive therein the side rail of an adjacent ladder section; and a cut protector cap portion integrally formed on the edge of said flat base section and adapted to be seated on the end of a ladder side rail.

13. The combined guide unit and cut protector of claim 12 including pad means integrally formed on the forward end of said base portion and adapted to extend through the flange of the side rail to which said unit is to be attached whereby said pad means is adapted to ride on an adjacently disposed side rail of an adjacent ladder side rail.

14. The unit of claim 13 wherein said unit is made of a die cast alloy.

15. The combined guide unit and cut protector of claim 13 said hook portion includes a face portion facing said pad means, and means defining a pair of angular surfaces on said face portion extending from the midpoint of said face portion to the top and bottom of said hook portion.

16. A guide unit for attachment to a ladder side rail comprising:

a substantially flat base section adapted to be fixedly attached to a ladder side rail;

a single hook portion integrally formed on said base section and adapted to receive therein the side rail of an adjacent ladder section;

pad means integrally formed on the forward end of said base portion and adapted to extend through the flange of the side rail to which said unit is to be attached whereby said pad means is adapted to ride on an adjacently disposed side rail of an adjacent ladder side rail;

said hook portion including a face portion facing said pad means; and means defining a pair of angular surfaces on said face portion extending from the midpoint of said face portion to the top and bottom of said hook portion.

* * * * *